US007922892B2

(12) United States Patent
Miller

(10) Patent No.: US 7,922,892 B2
(45) Date of Patent: Apr. 12, 2011

(54) PROCESS FOR IMPROVING THE LUBRICATING PROPERTIES OF BASE OILS USING A FISCHER-TROPSCH DERIVED BOTTOMS

(75) Inventor: Stephen J. Miller, San Francisco, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 1120 days.

(21) Appl. No.: 11/285,631

(22) Filed: Nov. 21, 2005

(65) Prior Publication Data

US 2006/0070914 A1 Apr. 6, 2006

Related U.S. Application Data

(62) Division of application No. 10/704,031, filed on Nov. 7, 2003, now Pat. No. 7,053,254.

(51) Int. Cl.
*C10M 101/02* (2006.01)
*C10M 105/02* (2006.01)

(52) U.S. Cl. ..... 208/18; 208/19; 208/950

(58) Field of Classification Search ..... 208/18, 208/19, 950
See application file for complete search history.

(56) References Cited

U.S. PATENT DOCUMENTS 6,506,297 B1 * 1/2003 Wittenbrink et al. ..... 208/18
6,846,778 B2 1/2005 Johnson et al.
7,053,254 B2 * 5/2006 Miller ..... 585/1
7,141,157 B2 * 11/2006 Rosenbaum et al. ..... 208/18
7,198,710 B2 * 4/2007 Miller et al. ..... 208/78
7,241,375 B2 * 7/2007 Johnson et al. ..... 208/18
7,285,206 B2 * 10/2007 Germaine ..... 208/108
7,347,928 B2 * 3/2008 Van Beijnum et al. ..... 208/18
7,473,347 B2 * 1/2009 Germaine ..... 208/89
2004/0043910 A1 3/2004 Lok et al.
2004/0065584 A1 4/2004 Bishop et al.
2004/0065588 A1 4/2004 Genetti et al.
2004/0094453 A1 5/2004 Lok et al.
2004/0178118 A1 9/2004 Rosenbaum et al.

FOREIGN PATENT DOCUMENTS

WO WO 2004/007647 A1 1/2004

OTHER PUBLICATIONS

Manka et al., Factors Affecting Performance of Crude Oil Wax-Control Additives, World Oil, Jun. 2001, pp. 75-81.

* cited by examiner

*Primary Examiner* — Ellen M McAvoy
(74) *Attorney, Agent, or Firm* — Merchant & Gould

(57) ABSTRACT

A method for improving the lubricating properties of a distillate base oil characterized by a pour point of 0 degrees C. or less and a boiling range having the 10 percent point falling between about 625 degrees F. and about 790 degrees F. and the 90 percent point falling between about 725 degrees F. and about 950 degrees F., the method comprises blending with said distillate base oil a sufficient amount of a pour point depressing base oil blending component to reduce the pour point of the resulting base oil blend at least 3 degrees C. below the pour point of the distillate base oil, wherein the pour point depressing base oil blending component is an isomerized Fischer-Tropsch derived bottoms product having a pour point that is at least 3 degrees C. higher than the pour point of the distillate base oil.

7 Claims, No Drawings

PROCESS FOR IMPROVING THE LUBRICATING PROPERTIES OF BASE OILS USING A FISCHER-TROPSCH DERIVED BOTTOMS

This application is a divisional of U.S. Ser. No. 10/704,031, filed on Nov. 7, 2003 now U.S. Pat. No. 7,053,254.

FIELD OF THE INVENTION

This invention is directed to a process for improving the lubricating properties of a distillate base oil by blending it with a pour point depressing base oil blending component prepared from an isomerized Fischer-Tropsch derived bottoms. The invention also includes the composition of the pour point depressing base oil blending component and of the base oil blend.

BACKGROUND OF THE INVENTION

Finished lubricants used for automobiles, diesel engines, axles, transmissions, and industrial applications consist of two general components, a lubricating base oil and additives. Lubricating base oil is the major constituent in these finished lubricants and contributes significantly to the properties of the finished lubricant. In general, a few lubricating base oils are used to manufacture a wide variety of finished lubricants by varying the mixtures of individual lubricating base oils and individual additives.

Numerous governing organizations, including original equipment manufacturers (OEM's), the American Petroleum Institute (API), Association des Consructeurs d' Automobiles (ACEA), the American Society of Testing and Materials (ASTM), and the Society of Automotive Engineers (SAE), among others, define the specifications for lubricating base oils and finished lubricants. Increasingly, the specifications for finished lubricants are calling for products with excellent low temperature properties, high oxidation stability, and low volatility. Currently, only a small fraction of the base oils manufactured today are able to meet these demanding specifications.

Lubricating base oils are base oils having a viscosity of about 3 cSt or greater at 100 degrees C., preferably about 4 cSt or greater at 100 degrees C.; a pour point of about 9 degrees C. or less, preferably about −15 degrees C. or less; and a VI (viscosity index) that is usually about 90 or greater, preferably about 100 or greater. In general, lubricating base oils should have a Noack volatility no greater than current conventional Group I or Group II light neutral oils. Group II base oils are defined as having a sulfur content of equal to or less than 300 ppm, saturates equal to 90 percent or greater, and a VI between 80 and 120. A Group II base oil having a VI between about 110 and 120 is referred to in this disclosure as a Group II plus base oil. Group III base oils are defined as having a sulfur content of equal to or less than 300 ppm, saturates equal to 90 percent or greater, and a VI of greater than 120. It would be advantageous to be able to boost the VI of a Group II base oil into the Group II plus and the Group III base oil range. The present invention makes it possible to lower pour point and raise VI. Depending upon the amount of pour point depressing base oil blending component added to the base oil blend, the Noack volatility may also be lowered and the viscosity of the base oil may be raised.

Base oil refers to a hydrocarbon product having the above properties prior to the addition of additives. That is, the term "base oil" generally refers to a petroleum or syncrude fraction recovered from the fractionation operation. "Additives" are chemicals which are added to improve certain properties in the finished lubricant so that it meets relevant specifications. Conventional pour point additives are expensive and add to the cost of the finished lubricant. Some additives also present solubility problems and require their use along with a solvent. Consequently, it is desirable to use the minimum amount of an additive necessary to produce an on specification lubricant.

Pour point which is an important property of base oils intended for blending into finished lubricants is the lowest temperature at which movement of the base oil is observed. In order to meet the relevant pour point specification for a finished lubricant, it is often necessary to lower the pour point of the base oil by the addition of an additive. Conventional additives which have been used to lower the pour point of base oils are referred to as pour point depressants (PPDs) and typically are polymers with pendant hydrocarbon chains that interact with the paraffins in the base by inhibiting the formation of large wax crystal lattices. Examples of pour point depressants known to the art include ethylene-vinyl-acetate copolymers, vinyl-acetate olefin copolymers, alkyl-esters of styrene-maleic-anhydride copolymers, alkyl-esters of unsaturated-carboxylic acids, polyalkylacrylates, polyalkylmethacrylates, alkyl phenols, and alpha-olefin copolymers. Many of the known pour point depressants are solid at ambient temperature and must be diluted drastically with solvent prior to use. See *Factors Affecting Performance of Crude Oil Wax-Control Additives* by J. S. Manka and K. L. Ziegler, World Oil, June 2001, pages 75-81. Pour point depressants taught in the literature have a wax-like paraffinic part, which co-crystallizes with the wax-forming components in the oil, and a polar part which hinders crystal growth. The pour point depressing base oil blending component employed in the present invention differs from pour point depressants known from the prior art in being essentially both aromatic-free and polar-free. One of the advantages of the present invention is that the pour point depressing base oil blending component of the present invention is not an additive in the conventional sense. The pour point depressing base oil blending component used in the invention is only a high boiling syncrude fraction which has been isomerized under controlled conditions to give a specified degree of alkyl branching in the molecule. Therefore, it does not lend itself to problems which have been associated with the use of conventional additives.

Syncrude prepared from the Fischer-Tropsch process comprises a mixture of various solid, liquid, and gaseous hydrocarbons. Those Fischer-Tropsch products which boil within the range of lubricating base oil contain a high proportion of wax which makes them ideal candidates for processing into lubricating base oil stocks. Accordingly, the hydrocarbon products recovered from the Fischer-Tropsch process have been proposed as feedstocks for preparing high quality lubricating base oils. When the Fischer-Tropsch waxes are converted into Fischer-Tropsch base oils by various processes, such as by hydroprocessing and distillation, the base oils produced fall into different narrow-cut viscosity ranges. Those Fischer-Tropsch cuts which have properties which make them suitable for preparing lubricating base oils are particularly advantageous for blending with marginal quality conventional base oils or Fischer-Tropsch derived base oils due to their low volatility, low sulfur content, and excellent cold flow properties. The bottoms that remains after recovering the lubricating base oil cuts from the vacuum column is generally unsuitable for use as a lubricating base oil itself and is usually recycled to a hydrocracking unit for conversion to lower molecular weight products. Applicant has found that the high molecular weight hydrocarbons associated with the bottoms when properly processed are particularly useful for improving the lubricating properties of base oils, either conventionally derived or Fischer-Tropsch derived.

As used in this disclosure the phrase "Fischer-Tropsch derived" refers to a hydrocarbon stream in which a substantial portion, except for added hydrogen, is derived from a Fischer-Tropsch process regardless of subsequent processing steps. Accordingly, a "Fischer-Tropsch derived bottoms" refers to a hydrocarbon product recovered from the bottom of a fractionation column, usually a vacuum column, which was initially derived from the Fischer-Tropsch process. When referring to conventional base oils, this disclosure is referring to conventional petroleum derived lubricating base oils produced using petroleum refining processes well documented in the literature and known to those skilled in the art. The term "distillate base oil" refers to either a "Fischer-Tropsch derived" or "conventional" base oil recovered as a side stream from a fractionation column as opposed to the "bottoms".

As used in this disclosure the word "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrase "consisting of" or "consists of" are intended as a transition meaning the exclusion of all but the recited elements with the exception of only minor traces of impurities.

SUMMARY OF THE INVENTION

In its broadest aspect the present invention is directed to a method for improving the lubricating properties of a distillate base oil characterized by a pour point of 0 degrees C. or less and a boiling range having the 10 percent point falling between about 625 degrees F. and about 790 degrees F. and the 90 percent point falling between about 725 degrees F. and about 950 degrees F., the method comprises blending with said distillate base oil a sufficient amount of a pour point depressing base oil blending component to reduce the pour point of the resulting base oil blend at least 3 degrees C. below the pour point of the distillate base oil, wherein the pour point depressing base oil blending component is an isomerized Fischer-Tropsch derived bottoms product having a pour point that is at least 3 degrees C. higher than the pour point of the distillate base oil. For example, if the target pour point of the distillate base oil is −9 degrees C. and the pour point of the distillate base oil is greater than −9 degrees C., an amount of the pour point depressing base oil blending component of the invention will be blended with the distillate base oil in sufficient proportion to lower the pour point of the blend to the target value. The isomerized Fischer-Tropsch derived bottoms product used to lower the pour point of the lubricating base oil is usually recovered as the bottoms from the vacuum column of a Fischer-Tropsch operation. The average molecular weight of the pour point depressing base oil blending component usually will fall within the range of from about 600 to about 1100 with an average molecular weight between about 700 and about 1000 being preferred. Typically the pour point of the pour point depressing base oil blending component will be between about −9 degrees C. and about 20 degrees C. The 10 percent point of the boiling range of the pour point depressing base oil blending component usually will be within the range of from about 850 degrees F. and about 1050 degrees F.

The invention is also directed to a pour point depressing base oil blending component suitable for lowering the pour point of a base oil which comprises an isomerized Fischer-Tropsch derived bottoms product having an average molecular weight between about 600 and about 1100 and an average degree of branching in the molecules between about 6.5 and about 10 alkyl branches per 100 carbon atoms.

The distillate base oil may be either a conventional petroleum-derived base oil or a Fischer-Tropsch derived base oil. It may be a light neutral base oil or a medium neutral base oil. Depending upon the amount of pour point depressing base oil blending component blended with the distillate base oil, the cloud point of the base oil blend may be raised. Therefore, if the cloud point of the base oil blend is a critical specification, the distillate base oil must have a cloud point no higher than the target cloud point. Preferably the cloud point of the distillate base oil will be lower than the target specification to allow for some rise in the cloud point and still meet the specification. Base oils intended for use in certain finished lubricants often require a cloud point of 0 degrees C. or less. Therefore, for base oils intended for those applications, a cloud point below 0 degrees C. is desirable.

In addition to lowering the pour point of the distillate base oil, the present invention also has been observed to increase the VI. In the case of both pour point and VI, the degree of change in these values could not have been predicted by only observing the properties of the individual components. In each case a premium was observed. That is to say, the pour point of the blend containing the distillate base oil and the pour point depressing base oil blending component is not merely a proportional averaging of the two pour points, but the value obtained is significantly lower than would be expected. The pour point in many cases has been observed to be lower than the value for either of the two individual components. The same is also true for VI. The VI of the mixture is not the proportional average of the VI's for the two components but is higher than would be expected, and in many cases, the VI of the base oil blend will exceed the VI of either component. Preferably, in the base oil blend, the pour point depressing base oil blending component will comprise no more than about 15 weight percent of the base oil of the blend, more preferably 7 weight percent or less, and most preferably 3.5 weight percent or less. Since it is usually desirable to maintain as low a cloud point as possible for the base oil blend, only the minimum amount of the pour point depressing base oil blending component necessary to meet the pour point and/or VI specifications is added to the distillate base oil. The pour point depressing base oil component will also increase the viscosity of the blend. Therefore the amount of the pour point depressing base oil component which can be added may also be limited by the upper viscosity limit.

DETAILED DESCRIPTION OF THE INVENTION

Pour point refers to the temperature at which a sample of the distillate base oil or the isomerized Fischer-Tropsch derived bottoms will begin to flow under carefully controlled conditions. In this disclosure, where pour point is given, unless stated otherwise, it has been determined by standard analytical method ASTM D-5950 or its equivalent. Cloud point is a measurement complementary to the pour point, and is expressed as a temperature at which a sample begins to develop a haze under carefully specified conditions. Cloud points in this specification were determined by ASTM D-5773-95 or its equivalent. Kinematic viscosity described in this disclosure was measured by ASTM D-445 or its equivalent. VI may be determined by using ASTM D-2270-93 (1998) or its equivalent. As used herein, an equivalent analytical method to the standard reference method refers to any analytical method which gives substantially the same results as the standard method. Molecular weight may be determined by ASTM D-2502, ASTM D-2503, or other suitable method. For use in association with this invention, molecular weight is preferably determined by ASTM D-2503-02.

The branching properties of the pour point depressing base oil blending component of the present invention was determined by analyzing a sample of oil using carbon-13 NMR according to the following seven-step process. References cited in the description of the process provide details of the process steps. Steps 1 and 2 are performed only on the initial materials from a new process.

1) Identify the CH branch centers and the $CH_3$ branch termination points using the DEPT Pulse sequence (Doddrell, D. T.; D. T. Pegg; M. R. Bendall, *Journal of Magnetic Resonance* 1982, 48, 323ff.).
2) Verify the absence of carbons initiating multiple branches (quaternary carbons) using the APT pulse sequence (Patt, S. L.; J. N. Shoolery, *Journal of Magnetic Resonance* 1982, 46, 535ff.).
3) Assign the various branch carbon resonances to specific branch positions and lengths using tabulated and calculated values (Lindeman, L. P., *Journal of Qualitative Analytical Chemistry* 43, 1971 1245ff; Netzel, D. A., et. al., *Fuel,* 60, 1981, 307ff).

Examples:

| Branch | NMR Chemical Shift (ppm) |
|---|---|
| 2-methyl | 22.5 |
| 3-methyl | 19.1 or 11.4 |
| 4-methyl | 14.0 |
| 4+ methyl | 19.6 |
| Internal ethyl | 10.8 |
| Propyl | 14.4 |
| Adjacent methyls | 16.7 |

4) Quantify the relative frequency of branch occurrence at different carbon positions by comparing the integrated intensity of its terminal methyl carbon to the intensity of a single carbon (=total integral/number of carbons per molecule in the mixture). For the unique case of the 2-methyl branch, where both the terminal and the branch methyl occur at the same resonance position, the intensity was divided by two before doing the frequency of branch occurrence calculation. If the 4-methyl branch fraction is calculated and tabulated, its contribution to the 4+methyls must be subtracted to avoid double counting.
5) Calculate the average carbon number. The average carbon number may be determined with sufficient accuracy for lubricant materials by dividing the molecular weight of the sample by 14 (the formula weight of $CH_2$).
6) The number of branches per molecule is the sum of the branches found in step 4.
7) The number of alkyl branches per 100 carbon atoms is calculated from the number of branches per molecule (step 6) times 100/average carbon number.

Measurements can be performed using any Fourier Transform NMR spectrometer. Preferably, the measurements are performed using a spectrometer having a magnet of 7.0 T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-d1 were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH. And the methyls are clearly identified by chemical shift and phase. Both are described in the references cited. The branching properties of each sample were determined by C-13 NMR using the assumption in the calculations that the entire sample was iso-paraffinic. Corrections were not made for n-paraffins or naphthenes, which may have been present in the oil samples in varying amounts. The naphthenes content may be measured using Field Ionization Mass Spectroscopy (FIMS).

Since conventional petroleum derived hydrocarbons and Fischer-Tropsch derived hydrocarbons comprise a mixture of varying molecular weights having a wide boiling range, this disclosure will refer to the 10 percent point and the 90 percent point of the respective boiling ranges. The 10 percent point refers to that temperature at which 10 weight percent of the hydrocarbons present within that cut will vaporize at atmospheric pressure. Similarly, the 90 percent point refers to the temperature at which 90 weight percent of the hydrocarbons present will vaporize at atmospheric pressure. In this disclosure when referring to boiling range distribution, the boiling range between the 10 percent and 90 percent boiling points is what is being referred to. For samples having a boiling range above 1000 degrees F., the boiling range distributions in this disclosure were measured using the standard analytical method D-6352 or its equivalent. For samples having a boiling range below 1000 degrees F., the boiling range distributions in this disclosure were measured using the standard analytical method D-2887 or its equivalent. It will be noted that only the 10 percent point is used when referring to the pour point depressing base oil blending component, since it is derived from a bottoms fraction which makes the 90 percent point or upper boiling limit irrelevant.

The Isomerized Fischer-Tropsch Bottoms

As already explained, the isomerized Fischer-Tropsch derived product which is employed as a pour point depressing base oil blending component in the present invention is separated as a high boiling bottoms fraction from the hydrocarbons produced during a Fischer-Tropsch synthesis reaction. The Fischer-Tropsch syncrude as initially recovered from the Fischer-Tropsch synthesis contains a waxy fraction that is normally a solid at room temperature. The waxy fraction may be produced directly from the Fischer-Tropsch syncrude or it may be prepared from the oligomerization of lower boiling Fischer-Tropsch derived olefins. Regardless of the source of the Fischer-Tropsch wax, it must contain hydrocarbons boiling above about 900 degrees F. in order to produce the bottoms used in preparing the pour point depressing base oil blending component of the present invention. In order to improve the pour point and VI, the Fischer-Tropsch wax is isomerized to introduce favorable branching into the molecules. The isomerized Fischer-Tropsch derived wax will usually be sent to a vacuum column where the various distillate base oil cuts are collected. These distillate base oil fractions may be used to prepare the lubricating base oil blends of the present invention, or they may be cracked into-lower boiling products, such as diesel or naphtha. The bottoms material collected from the vacuum column comprises a mixture of high boiling hydrocarbons which is used to prepare the pour depressing base oil blending component of the present invention. In addition to isomerization and fractionation, the Fischer-Tropsch derived waxy fraction may undergo various other operations, such as hydrocracking, hydrotreating, and hydrofinishing. The pour point depressing base oil blending component of the present invention is not an additive in the normal use of this term within the art, since it is really only a high boiling fraction recovered from the Fischer-Tropsch syncrude.

It has been found that when the isomerized Fischer-Tropsch derived bottoms is used to reduce the pour point, the pour point of the lubricating base oil blend will be below the pour point of both the pour point depressing base oil blending component and the distillate base oil. Therefore, it is usually not necessary to reduce the pour point of the Fischer-Tropsch derived bottoms to the target pour point of the lubricating base oil blend. Accordingly, the actual degree of isomerization need not be as high as might otherwise be expected, and the isomerization reactor may be operated at a lower severity with less cracking and less yield loss. It has been found that the Fischer-Tropsch derived bottoms should not be over isomerized or its ability to act as a pour point depressing base oil blending component will be compromised. Accordingly, the average degree of branching in the molecules of the bottoms should fall within the range of from about 6.5 to about 10 alkyl branches per 100 carbon atoms.

The pour point depressing base oil blending component will have an average molecular weight between about 600 and about 1100, preferably between about 700 and about 1000. The kinematic viscosity at 100 degrees C. will usually fall within the range of from about 8 cSt to about 22 cSt. The 10 percent point of the boiling range of the bottoms typically will fall between about 850 degrees F. and about 1050 degrees F. Generally, the higher molecular weight hydrocarbons are more effective as pour point depressing base oil blending components than the lower molecular weight hydrocarbons. Consequently, higher cut points in the fractionation column which result in a higher boiling bottoms material are usually preferred when preparing the pour point depressing base oil blending component. The higher cut point also has the advantage of resulting in a higher yield of the distillate base oil fractions.

It has also been found that by solvent dewaxing the isomerized bottoms material, the effectiveness of the pour point depressing base oil blending component may be enhanced. The waxy product separated during solvent dewaxing from the Fischer-Tropsch derived bottoms has been found to display improved pour point depressing properties. The oily product recovered after the solvent dewaxing operation while displaying some pour point depressing properties is less effective than the waxy product.

The Distillate Base Oil

The separation of Fischer-Tropsch derived products and petroleum derived products into various fractions having characteristic boiling ranges is generally accomplished by either atmospheric or vacuum distillation or by a combination of atmospheric and vacuum distillation. As used in this disclosure, the term "distillate fraction" or "distillate" refers to a side stream product recovered either from an atmospheric fractionation column or from a vacuum column as opposed to the "bottoms" which represents the residual higher boiling fraction recovered from the bottom of the column. Atmospheric distillation is typically used to separate the lighter distillate fractions, such as naphtha and middle distillates, from a bottoms fraction having an initial boiling point above about 700 degrees F. to about 750 degrees F. (about 370 degrees C. to about 400 degrees C.). At higher temperatures thermal cracking of the hydrocarbons may take place leading to fouling of the equipment and to lower yields of the heavier cuts. Vacuum distillation is typically used to separate the higher boiling material, such as the distillate base oil fractions which are used in carrying out the present invention. Thus the distillate base oil and the Fischer-Tropsch derived bottoms product are usually recovered from the vacuum distillation column, although the invention is not intended to be limited to any particular mode of separating the components.

The distillate base oil fractions used in carrying out the invention are characterized by a pour point of 0 degrees C. or less and a boiling range having the 10 percent point falling between about 625 degrees F. and about 790 degrees F. and the 90 percent point falling between about 725 degrees F. and about 950 degrees F. Usually the 90 percent point will fall between about 725 degrees F. and 900 degrees F. The distillate base oil may be either conventionally derived from the refining of petroleum or syncrude recovered from a Fischer-Tropsch synthesis reaction. The distillate base oil may be a light neutral base oil or a medium neutral base oil. The distillate base oil will usually have a kinematic viscosity at 100 degrees C. between about 2.5 cSt and about 7 cSt. Preferably, the viscosity will be between about 3 cSt and about 7 cSt at 100 degrees C. If the target cloud point for the lubricating base oil blend is 0 degrees C., the cloud point of the distillate base oil preferably should be 0 degrees C. or less.

If the distillate base oil contains a high proportion of wax, such as with a Fischer-Tropsch derived base oil, it is usually necessary to dewax the base oil. This may be accomplished by either catalytic dewaxing or by solvent dewaxing. Hydroisomerization which is used in the preparation of the isomerized Fischer-Tropsch derived bottoms may also be advantageously used to dewax the distillate base oil fraction. Hydroisomerization is particularly preferred when both the distillate base oil and the pour point depressing base oil blending component are recovered from a Fischer-Tropsch operation. Typically in such operations the entire base oil fraction which contains a great amount of wax is isomerized followed by fractionation in a vacuum column.

The present invention is particularly advantageous when used with distillate base oils having a VI of less than 110, since such base oils are usually unsuitable for preparing high quality lubricants without the addition of significant amounts of VI improvers. Due to the VI premium which has been observed when using the pour point depressing base oil blending component of the invention, the VI of marginal base oils may be significantly improved without the use of conventional additives. The pour point depressing base oil blending component of the present invention by increasing the VI, makes it possible to upgrade Group II base oils having a VI of less than 110 up to Group II plus base oils. It is also possible by using the present invention to upgrade Group II base oils to Group III base oils.

Lubricating Base Oil Product

A lubricating base oil blend prepared according to the process of the present invention will have a kinematic viscosity greater than about 3 cSt at 100 degrees C. Usually the kinematic viscosity at 100 degrees C. will not exceed about 8 cSt. The lubricating base oil blend will also have a pour point below about −9 degrees C. and a VI that is usually greater than about 90. Preferably the kinematic viscosity at 100 degrees C. will be between about 3 cSt and about 7 cSt, the pour point will be about −15 degrees C. or less, and the VI will be about 100 or higher. Even more preferably the VI will be 110 or higher. The cloud point of the lubricating base oil preferably will be 0 degrees C. or below. The pour point of the lubricating base oil blend will be at least 3 degrees C. lower than the pour point of the lower viscosity component of the blend. Preferably, the pour point of the blend will be at least 6 degrees C. below the pour point of the distillate base oil and more preferably at least 9 degrees C. below the pour point of the distillate base oil. At the same time, the VI of the blend will preferably be raised by at least three numbers above the VI of the distillate base oil. The properties of the lubricating base oils prepared using the process of the invention are achieved by blending the distillate base oil with the minimum amount of the pour point depressing base oil blending component necessary to meet the desired specifications for the product.

In achieving the selected pour points, the pour point depressing base oil blending component usually will not comprise more than about 15 weight percent of the base oil blend. Preferably, it will comprise 7 weight percent or less, and most preferably the pour point depressing base oil blending component will comprise 3.5 weight percent or less of the blend. The minimum amount of the pour point depressing base oil blending component to meet the desired specifications for pour point and VI are usually preferred to avoid raising the cloud point and/or viscosity of the blend to an unacceptable level. At the lower levels of addition, the effect on cloud point is generally negligible.

As already noted, when the pour point depressing base oil blending component is blended with the distillate base oil, a VI premium is observed. The term "VI premium" refers to a VI boost in which the VI of the blend is significantly higher than would have been expected from a mere proportional averaging of the VI's for the two fractions. The improvement in VI resulting from the practice of the present invention makes it possible to produce a Group III base oil, i.e., a base oil having a VI greater than 120, from a Group II base oil, i.e., a base oil having a VI between 80 and 120. A Group II plus base oil may also be prepared from a Group II base oil having a VI below about 110.

In order to qualify as a Group II base oil, the base oil must contain 300 ppm of sulfur or less. In the case of a conventional petroleum derived distillate base oil having a marginal sulfur content, blending in the isomerized high boiling Fischer-Tropsch product may also serve to lower the sulfur content to meet sulfur specifications. Fischer-Tropsch derived hydrocarbons contain very low levels of sulfur and, therefore, are ideal for blending with marginal conventional petroleum derived base oils to meet sulfur specifications.

A further advantage of the process of the present invention is that the volatility of the lubricating base oil blend may be lowered relative to that of the distillate base oil fraction. The pour point depressing base oil blending component is characterized by a very low Noack volatility. Consequently, depending upon how much of the pour point depressing base oil blending component is blended with the distillate base oil, the lubricating base oil blend may have a lower Noack volatility than the distillate base oil fraction alone.

Lubricating base oil blends prepared according to the process of the present invention display a distinctive boiling range profile. Therefore, the lubricating base oil blend comprising the distillate base oil and the pour point depressing base oil blending component may be described as a lubricating base oil having a viscosity at 100 degrees C. between about 3 cSt and about 8 cSt and further containing a high boiling fraction boiling above about 900 degrees F. and a low boiling fraction boiling below about 900 degrees F., wherein when the high boiling fraction is distilled out the low boiling fraction will have a higher pour point than the entire lubricating base oil. The low boiling fraction corresponds to the distillate base oil, and the high boiling fraction corresponds to the pour point depressing base oil blending component.

Lubricating base oil blends of the invention may be identified by using simulated distillation to determine the 900 degrees F. weight percent point. For instance, if the blend is 85 weight percent below 900 degrees F., one would distill off, by conventional distillation methods well known to those skilled in the art, 85 weight percent of the blend to get a 900 degrees F. cutpoint.

Hydroisomerization

Hydroisomerization, or for the purposes of this disclosure simply "isomerization", is intended to improve the cold flow properties of Fischer-Tropsch derived or petroleum derived wax by the selective addition of branching into the molecular structure. In the present invention, it is essential that the Fischer-Tropsch derived bottoms be isomerized at some point during its processing in order to make it suitable for use as a pour point depressing base oil blending component. Waxy petroleum derived base oils also may be advantageously isomerized in preparing them for use in the present invention.

Isomerization ideally will achieve high conversion levels of the wax to non-waxy iso-paraffins while at the same time minimizing the conversion by cracking. Since wax conversion can be complete, or at least very high, this process typically does not need to be combined with additional dewaxing processes to produce a high boiling Fischer-Tropsch product with an acceptable pour point. Isomerization operations suitable for use with the present invention typically use a catalyst comprising an acidic component and may optionally contain an active metal component having hydrogenation activity. The acidic component of the catalyst preferably includes an intermediate pore SAPO, such as SAPO-11, SAPO-31, and SAPO-41, with SAPO-11 being particularly preferred. Intermediate pore zeolites, such as ZSM-22, ZSM-23, SSZ-32, ZSM-35, and ZSM-48, also may be used in carrying out the isomerization. Typical active metals include molybdenum, nickel, vanadium, cobalt, tungsten, zinc, platinum, and palladium. The metals platinum and palladium are especially preferred as the active metals, with platinum most commonly used.

The phrase "intermediate pore size", when used herein, refers to an effective pore aperture in the range of from about 4.0 to about 7.1 Angstrom (as measured along both the short or long axis) when the porous inorganic oxide is in the calcined form. Molecular sieves having pore apertures in this range tend to have unique molecular sieving characteristics. Unlike small pore zeolites such as erionite and chabazite, they will allow hydrocarbons having some branching into the molecular sieve void spaces. Unlike larger pore zeolites such as faujasites and mordenites, they are able to differentiate between n-alkanes and slightly branched alkenes, and larger alkanes having, for example, quaternary carbon atoms. See U.S. Pat. No. 5,413,695. The term "SAPO" refers to a silicoaluminophosphate molecular sieve such as described in U.S. Pat. Nos. 4,440,871 and 5,208,005.

In preparing those catalysts containing a non-zeolitic molecular sieve and having a hydrogenation component, it is usually preferred that the metal be deposited on the catalyst using a non-aqueous method. Non-zeolitic molecular sieves include tetrahedrally-coordinated [AlO2] and [PO2] oxide units which may optionally include silica. See U.S. Pat. No. 5,514,362. Catalysts containing non-zeolitic molecular sieves, particularly catalysts containing SAPO's, on which the metal has been deposited using a non-aqueous method have shown greater selectivity and activity than those catalysts which have used an aqueous method to deposit the active metal. The non-aqueous deposition of active metals on non-zeolitic molecular sieves is taught in U.S. Pat. No. 5,939,349. In general, the process involves dissolving a compound of the active metal in a non-aqueous, non-reactive solvent and depositing it on the molecular sieve by ion exchange or impregnation.

Solvent Dewaxing

In conventional refining, solvent dewaxing is used to remove small amounts of any remaining waxy molecules from the lubricating base oil after hydroisomerization. In the present invention, solvent dewaxing may optionally be used to enhance the pour point depressing properties of the isomerized Fischer-Tropsch derived bottoms. In this instance, the waxy fraction recovered from the solvent dewaxing step was found to be more effective in lowering pour point than the oily fraction. Solvent dewaxing is done by dissolving the Fischer-Tropsch derived bottoms in a solvent, such as methyl ethyl ketone, methyl iso-butyl ketone, or toluene. See U.S. Pat. Nos. 4,477,333; 3,773,650; and 3,775,288.

The following examples are intended to illustrate the invention but are not to be construed as a limitation on the scope of the invention.

EXAMPLES

Example 1

A hydrotreated Fischer-Tropsch wax (having the specifications shown in Table I) was hydroisomerized over a Pt/SAPO-11 catalyst containing 15 weight percent alumina binder. Run conditions included a liquid hourly space velocity (LHSV) of 1.0, a total pressure of 1000 psig, a once-through hydrogen rate of 5300 SCF/bbl, and a reactor temperature of 680 degrees F. The catalyst was pre-sulfided at the start of the run using DMDS in dodecane at 645 degrees F., with 6 moles S fed per mole of Pt. The product from the hydroisomerization reactor went directly to a hydrofinishing reactor containing a Pt—Pd/SiO2-Al2O3 catalyst, at a LHSV of 2.1, and a temperature of 450 degrees F., with the same pressure and hydrogen rate as in the isomerization reactor. The product from this reactor went to a high pressure separator, with the liquid going to a stripper, then to product collection.

The 650 degrees F.+ bottoms product (having the specifications shown in Table II), which had a pour point of −19 degrees C. was fractionated into a 650-750 degrees F. cut, a 750-850 degrees F. cut, an 850-950 degrees F. cut, and a 950 degrees F.+ bottoms. Inspections on these cuts are given in Table II, showing all the cuts to have pour points greater than the −19 degrees C. of the whole 650 degrees F.+ bottoms. Recombining the cuts in the same proportions as in the distillation again gave a composite of −19 degrees C. pour point.

A blend of 85 weight percent of the 650-750 degrees F. 2.6 cSt cut and 15 weight percent of the 950 degrees F.+ bottoms was prepared. The blend had a pour point of −27 degrees C. (Table III), lower than the pour point of either cut separately.

TABLE I

| Hydrotreated FT Wax | |
|---|---|
| Gravity, ° API | 40.3 |
| Pour Point, ° C. | +79 |
| Sulfur, ppm | 2 |
| Nitrogen, ppm | 1 |
| Oxygen, Wt. % | 0.11 |
| Sim. Dist., Wt. %, ° F. | |
| ST/5 | 479/590 |
| 10/30 | 639/728 |
| 50 | 796 |
| 70/90 | 884/1005 |
| 95/EP | 1062/1187 |

TABLE II

Inspections of 650° F.+ of FT Wax Isomerized at 1000 psig over Pt/SAPO-11

| | |
|---|---|
| Gravity, ° API | 42.1 |
| Pour Point, ° C. | −19 |
| Cloud Point, ° C. | +10 |
| Viscosity, 40° C., cSt | 17.55 |
| 100° C., cSt | 4.303 |
| VI | 161 |

| | 650-750° F. | 750-850° F. | 850-950° F. | 950° F.+ |
|---|---|---|---|---|
| Fraction, Wt. % | 37.7 | 27.8 | 18.4 | 16.1 |
| Gravity, ° API | 43.9 | 42.5 | 40.6 | 38.0 |
| Pour Point, ° C. | −17 | −9 | −2 | +3 |
| Cloud Point, ° C. | −16 | −4 | +37 | +29 |
| Viscosity, 40° C., cSt | 9.032 | 14.65 | 27.99 | 88.13 |
| Viscosity, 100° C., cSt | 2.648 | 3.742 | 5.957 | 14.19 |
| VI | 135 | 151 | 166 | 167 |
| Sim. Dist., Wt. %, ° F. | | | | |
| ST/5 | 612/648 | 656/693 | 740/791 | 884/927 |
| 10/30 | 658/685 | 711/756 | 812/849 | 949/1004 |
| 50 | 710 | 790 | 894 | 1052 |
| 70/90 | 739/791 | 826/882 | 929/980 | 1104/1186 |
| 95/EP | 819/896 | 912/990 | 1003/1061 | 1221/1285 |

TABLE III

Inspections of Blend of 85/15 Wt. % 650-750° F./950° F.+ Cuts of Table II

| | |
|---|---|
| Pour Point, ° C. | −27 |
| Cloud Point, ° C. | +6 |
| Viscosity, 40° C., cSt | 12.71 |
| 100° C., cSt | 3.426 |
| VI | 154 |

Example 2

Another 650 degrees F.+ bottoms product (Table IV) was collected from the same run as in Example 1, except that the total pressure in the reactors was 300 psig and the temperature in the hydroisomerization reactor was 670 degrees F. The product was fractionated into a 6.50-730 degrees F. cut, a 730-850 degrees F. cut, and an 850 degrees F.+ cut. Inspections on these cuts are given in Table IV.

A blend of 63 weight percent of the 730-850 degrees F. 3.5 cSt cut and 37 weight percent of the 850 degrees F.+ cut was prepared (Table V). The blend had a pour point of −13 degrees C., lower than the pour point of either cut separately.

TABLE IV

Inspections of 650° F.+ of FT Wax Isomerized at 300 psig over Pt/SAPO-11

| | | |
|---|---|---|
| Gravity, ° API | | 42.4 |
| Pour Point, ° C. | | −16 |
| Cloud Point, ° C. | | +13 |
| Viscosity, | 40° C., cSt | 17.41 |
| | 100° C., cSt | 4.320 |
| VI | | 166 |

| | 650-730° F. | 730-850° F. | 850° F.+ |
|---|---|---|---|
| Fraction, Wt. % | 28.7 | 29.9 | 41.4 |
| Gravity, ° API | 44.4 | 42.9 | 39.6 |
| Pour Point, ° C. | −19 | −8 | −5 |
| Cloud Point, ° C. | −12 | −5 | +24 |
| Viscosity, 40° C., cSt | 8.312 | 12.99 | 45.11 |
| 100° C., cSt | 2.522 | 3.460 | 8.584 |
| VI | 140 | 151 | 171 |
| Sim. Dist., Wt. %, ° F. | | | |
| ST/5 | 597/636 | 646/684 | 767/805 |
| 10/30 | 648/676 | 701/742 | 827/886 |
| 50 | 699 | 773 | 939 |
| 70/90 | 726/773 | 805/855 | 1006/1119 |
| 95/EP | 799/884 | 882/963 | 1180/1322 |

TABLE V

Inspections of Blend of 63/37 Wt, % 730-850° F./850° F.+ Cuts of Table IV

| | | |
|---|---|---|
| Pour Point, ° C. | | −13 |
| Cloud Point, ° C. | | +13 |
| Viscosity, | 40° C., cSt | 20.83 |
| | 100° C., cSt | 4.888 |
| VI | | 168 |

Example 3

A run similar to that in Example 2 was carried out on a feed similar to that of Table I.

The 650 degrees F.+ bottoms product was cut into three fractions, a 650-730 degrees F. cut, a 730-930 degrees F. cut, a 930-1000 degrees F. cut, and a 1000 degrees F.+ bottoms. Inspections of the three highest boiling cuts are given in Table VI.

TABLE VI

Inspections of 650° F.+ of Isomerized FT Wax

| | 730-930° F. | 930-1000° F. | 1000° F.+ |
|---|---|---|---|
| Pour Point, ° C. | −17 | −17 | −6 |
| Cloud Point, ° C. | −10 | +1 | +20 |
| Viscosity, 40° C., cSt | 18.3 | 46.5 | 114.0 |
| 100° C., cSt | 4.3 | 8.3 | 16.6 |
| VI | 147 | 156 | 157 |
| Sim. Dist., Wt. %, ° F. | | | |
| ST/5 | 665/708 | | 940/978 |
| 10/30 | 727/777 | | 996/1040 |
| 50 | 818 | | 1077 |
| 70/90 | 861/920 | | 1121/1196 |
| 95/EP | 949/1023 | | 1235/1310 |

Blends of the 730-930 degrees F. cut and the 1000 degrees F.+ cut were prepared. Results are shown in Table VII. These show the blends to have lower pour points than either fraction separately. In the 85/15 case, the VI is higher than for either fraction separately.

TABLE VII

Inspections on Blends of the 730-930° F. Cut and 1000° F.+ Cut from Table VI

| | | | |
|---|---|---|---|
| Blend, Wt./Wt. % | 85/15 | 93/7 | 96.5/3.5 |
| Pour Point, ° C. | −28 | −28 | −22 |
| Cloud Pt, ° C. | +6 | 0 | −4 |
| Viscosity, 40° C., cSt | 24.06 | 20.95 | 19.57 |
| 100° C., cSt | 5.282 | 4.759 | 4.515 |
| VI | 161 | 154 | 150 |

Comparative Example A

Blends of the 930-1000 degrees F. cut from Table VI and the 1000 degrees F.+ cut were prepared. Results are shown in Table VIII. These show the pour point reduction of these blends to be considerably less than in Example 3.

TABLE VIII

Inspections on Blends of the 930-1000° F. Cut and 1000° F.+ Cut from Table VI

| | | | |
|---|---|---|---|
| Blend, Wt./Wt. % | | 93/7 | 96.5/3.5 |
| Pour Point, ° C. | | −15 | −12 |
| Cloud Pt, ° C. | | −2 | +5 |
| Viscosity, | 40° C., cSt | 49.35 | 47.91 |
| | 100° C., cSt | 8.753 | 8.556 |
| VI | | 157 | 157 |

Example 4

The hydrotreated FT wax of Table I was isomerized over a Pt/SSZ-32 catalyst at the same conditions as in Example 1, except for an isomerization temperature of 690 degrees F.

The 650 degrees F.+ bottoms product (Table IX), which had a pour point of −21 degrees C. was fractionated into a 650-750 degrees F. cut, a 750-850 degrees F. cut, a 850-950 degrees F. cut, and a 950 degrees F.+ bottoms. Inspections on these cuts are given in Table IX, showing all the cuts to have pour points greater than the −21 degrees C. of the whole 650 degrees F.+ bottoms. Recombining the cuts in the same proportions as in the distillation gave a composite of −25 degrees C. pour point. A blend of 85 weight percent of the 650-750 degrees F. 3.0 cSt cut and 15 weight percent of the 950 degrees F.+ bottoms was prepared. The blend had a pour point of −26 degrees C. (Table X), lower than the pour point of either cut separately. Furthermore, the VI of the 3.8 cSt blend was 7 numbers higher than the 3.8 cSt fraction produced by isomerization only, and the pour point was 20 degrees C. lower.

TABLE IX

Inspections of 650° F.+ of FT Wax Isomerized at 1000 psig over Pt/SSZ-32

| | | |
|---|---|---|
| Gravity, ° API | | 41.1 |
| Pour Point, ° C. | | −21 |
| Cloud Point, ° C. | | +15 |
| Viscosity, | 40° C., cSt | 22.06 |
| | 100° C., cSt | 5.081 |
| VI | | 169 |

TABLE IX-continued

Inspections of 650° F.+ of FT Wax Isomerized at 1000 psig over Pt/SSZ-32

| | | 650-750° F. | 750-850° F. | 850-950° F. | 950° F.+ |
|---|---|---|---|---|---|
| Fraction, Wt. % | | 23.6 | 36.3 | 23.6 | 16.4 |
| Gravity, ° API | | 43.6 | 42.3 | 40.6 | 37.5 |
| Pour Point, ° C. | | −13 | −6 | −8 | −1 |
| Cloud Point, ° C. | | −9 | −2 | +12 | +36 |
| Viscosity, | 40° C., cSt | 10.74 | 15.36 | 29.91 | 87.71 |
| | 100° C., cSt | 3.007 | 3.876 | 6.278 | 13.95 |
| VI | | 142 | 153 | 167 | 164 |
| Sim. Dist., Wt. %, ° F. | | | | | |
| ST/5 | | 636/678 | 675/707 | 736/801 | 892/932 |
| 10/30 | | 690/716 | 723/764 | 822/869 | 953/1003 |
| 50 | | 737 | 796 | 902 | 1047 |
| 70/90 | | 764/808 | 829/880 | 937/987 | 1093/1169 |
| 95/EP | | 833/904 | 906/975 | 1009/1078 | 1202/1264 |

TABLE X

Inspections of Blend of 85/15 Wt. % 650-750° F./950° F. + Cuts of Table IX

| | | |
|---|---|---|
| Pour Point, ° C. | | −26 |
| Cloud Point, ° C. | | +10 |
| Viscosity, | 40° C., cSt | 14.83 |
| | 100° C., cSt | 3.835 |
| VI | | 160 |

Comparative Example B

The 1000 degrees F.+ bottoms of Table VI was solvent dewaxed at −30 degrees C. to give a dewaxed oil fraction of 14.7 weight percent and a waxy fraction of 84.8 weight percent. Adding 1 weight percent of the dewaxed oil fraction to the 730-930 degrees F. fraction of Table VI gave a blend of −13 degrees C. pour point, higher than the pour point of the 730-930 degrees F. fraction.

Example 5

The wax fraction from Comparative Example B was solvent dewaxed at −10 degrees C. to give a dewaxed oil fraction of 79.3 weight percent, and a waxy fraction of 20.2 weight percent. Inspections of these fractions are given in Table XI.

TABLE XI

Inspections of the Fractions from Solvent Dewaxing the 1000° F. + Waxy Fraction from Comparative Example B at −10° C.

| Fraction | | Dewaxed Oil | Waxy Fraction |
|---|---|---|---|
| Pour Point, ° C. | | −5 | +10 |
| Cloud Point, ° C. | | +18 | +30 |
| Viscosity, | 40° C., cSt | 114.4 | 127.5 |
| | 100° C., cSt | 16.72 | 18.74 |
| VI | | 159 | 166 |

C-13 NMR results of the waxy fraction is shown below.

| | |
|---|---|
| MW | 802 |
| Number of Carbons | 57.29 |
| NMR Analysis | |
| 2-methyl | 0.25 |
| 3-methyl | 0.33 |
| 4-methyl | 0.55 |
| 5+ methyl | 2.12 |
| Internal ethyl | 0.92 |
| Adjacent methyl | 0.17 |
| Internal Propyl | 0.25 |
| Sum | 4.60 |
| Alkyl Branches per Molecule | 4.60 |
| Alkyl Branches per 100 Carbons | 8.03 |
| Raw Data | |
| Total Carbon Integral | 342.5 |
| 2-integral | 3 |
| 3-integral | 2 |
| 4-integral | 4.8 |
| 5+ integral | 16 |
| Internal ethyl integral | 5.5 |
| Adjacent methyls | 1 |
| Internal propyls | 1.5 |
| Epsilon carbons | 87 |
| Divisions per carbon | 5.98 |
| Methyl protons | 160.4 |
| Total protons | 825.26 |

Blends with the 730-930 degrees F. fraction of Table VI were prepared. Results are shown in Table XII. These show the waxy fraction to be more effective at reducing pour point than the dewaxed oil fraction, requiring only 1 weight percent to lower the pour point of the 730-930 degrees F. cut from −17 degrees C. to −24 degrees C.

TABLE XII

Inspections of Blends of 730-930° F. Cut of Table VI with the 1000° F. + Dewaxed Oil (DWO) or Waxy Fractions of Example 5

| Blend, Wt./Wt. % | | 94/6 | 97/3 | 99/1 |
|---|---|---|---|---|
| 1000° F.+ Blend Component | | DWO | DWO | Waxy |
| Pour Point, ° C. | | −26 | −23 | −24 |
| Cloud Pt, ° C. | | −4 | −7 | −7 |
| Viscosity, | 40° C., cSt | 20.42 | 19.13 | 18.65 |
| | 100° C., cSt | 4.692 | 4.481 | 4.366 |
| VI | | 155 | 154 | 149 |

Example 6

A high pour point commercial 100N base oil (Table XIII) was blended at a 93/7 weight percent ratio with the 1000 degrees F.+ bottoms of Table VI. Results are given in Table XIV. These results show the 1000 degrees F.+ bottoms effective at reducing the pour point of the 100N base oil, as well as producing a substantial increase in VI of 11 numbers.

TABLE XIII

Inspections of High Pour 100N Base Oil

| | | |
|---|---|---|
| Pour Point, ° C. | | −10 |
| Cloud Point, ° C. | | −8 |
| Viscosity, | 40° C., cSt | 19.52 |
| | 100° C., cSt | 4.027 |
| VI | | 103 |

TABLE XIV

| Inspections of a 93/7 Wt./Wt. % Blend of the 100N Base Oil of Table XIII and the 1000° F. + Bottoms of Table VI | |
|---|---|
| Pour Point, ° C. | −15 |
| Cloud Point, ° C. | −2 |
| Viscosity, 40° C., cSt | 22.30 |
| 100° C., cSt | 4.487 |
| VI | 114 |

Comparative Example C

An 85/15 weight percent blend was made using the 650-750 degrees F. cut and the 850-950 degrees F. cut of Table II. This gave a pour point for the blend of −16 degrees C., much higher than the −27 degrees C. for the 650-750 degrees F./950 degrees F.+ blend of Table III. The VI of the blend was 141, well below the 154 of the blend of Table III, despite the 850-950 degrees F. and 950 degrees F.+ fractions having about the same VI.

Comparative Example D

An 85/15 weight percent blend was made using the 650-750 degrees F. cut and the 850-950 degrees F. cut of Table IX. This gave a pour point for the blend of −8 degrees C., much higher than the −26 degrees C. for the 650-750 degrees F./950 degrees F.+ blend of Table X. The VI of the blend was 149, well below the 160 of the blend of Table X, despite the 850-950 degrees F. fraction having a higher VI than the 950 degrees F.+ fraction.

What is claimed is:

1. A pour point depressing base oil blending component suitable for lowering the pour point of a base oil which comprises an isomerized Fischer-Tropsch derived bottoms product having an average molecular weight between about 600 and about 1100 and an average degree of branching in the molecules between about 6.5 and about 10 alkyl branches per 100 carbon atoms, and when 7.0 weight percent is blended with an isomerized distillate base oil characterized by a pour point between about −12 degrees C. and about −18 degrees C., the pour point of the resulting base oil blend will be at least 3 degrees C. lower than the pour point of said isomerized distillate base oil.

2. The pour point depressing base oil blending component of claim 1 wherein the average molecular weight falls within the range of from about 700 to about 1000.

3. The pour point depressing base oil blending component of claim 1 having a pour point falling between about −9 degrees C. and about 20 degrees C.

4. The pour point depressing base oil blending component of claim 1 having a boiling range in which the 10 percent point falls between about 850 degrees F. and about 1050 degrees F.

5. The pour point depressing base oil blending component of claim 1 wherein the kinematic viscosity at 100 degrees C. is within the range of from about 8 and about 22 cSt.

6. The pour point depressing base oil blending component of claim 1 wherein the pour point of the resulting base oil blend will be at least 6 degrees lower than the pour point of the isomerized distillate base oil.

7. The pour point depressing base oil blending component of claim 1 wherein the VI of the resulting base oil blend will be at least 3 numbers higher than the VI of the isomerized distillate base oil.

* * * * *